US010808697B2

(12) United States Patent
Wang et al.

(10) Patent No.: US 10,808,697 B2
(45) Date of Patent: Oct. 20, 2020

(54) PUMP ASSEMBLY HAVING INTEGRATED CONTROLLER AND MOTOR WITH INTERNAL ACTIVE COOLING

(71) Applicant: Stackpole International Engineered Products, Ltd., Ontario (CA)

(72) Inventors: Liping Wang, Toronto (CA); Richard Muizelaar, Ontario (CA)

(73) Assignee: Stackpole International Engineered Products, Ltd., Ontario (CA)

( * ) Notice: Subject to any disclaimer, the term of this patent is extended or adjusted under 35 U.S.C. 154(b) by 216 days.

(21) Appl. No.: 15/653,690

(22) Filed: Jul. 19, 2017

(65) Prior Publication Data

US 2018/0023565 A1 Jan. 25, 2018

Related U.S. Application Data

(60) Provisional application No. 62/404,975, filed on Oct. 6, 2016, provisional application No. 62/364,540, filed on Jul. 20, 2016.

(51) Int. Cl.
*F04C 15/00* (2006.01)
*F04C 15/06* (2006.01)
(Continued)

(52) U.S. Cl.
CPC ..... *F04C 15/0096* (2013.01); *F04C 2/10* (2013.01); *F04C 2/102* (2013.01); *F04C 11/008* (2013.01);
(Continued)

(58) Field of Classification Search
CPC ..... F04D 13/0606; F04D 13/0686; F04D 29/426; F04D 29/5813; F04D 13/06; F04D 25/06; F04D 29/026; F04D 29/588
See application file for complete search history.

(56) References Cited

U.S. PATENT DOCUMENTS 5,332,369 A 7/1994 Jensen
6,082,974 A 7/2000 Takemoto et al.
(Continued)

FOREIGN PATENT DOCUMENTS

DE 102007036239 A1 * 2/2009 ..... F04D 13/0686
DE 102007036239 A1 2/2009
(Continued)

OTHER PUBLICATIONS

International Search Report PCT/IB2017/054370 dated Nov. 29, 2017.
(Continued)

*Primary Examiner* — Dominick L Plakkoottam
(74) *Attorney, Agent, or Firm* — Pillsbury Winthrop Shaw Pittman, LLP

(57) ABSTRACT

A pump assembly and a method for cooling the same are disclosed. The pump assembly includes a pump, a controller, and a driven electric motor. The pump and the electric motor are on opposing axial sides of the controller. The assembly also has a heat conductive plate positioned between the pump and the controller that conducts heat from the controller. A transfer passage is provided for receiving pressurized fluid output from the pump and to direct the fluid along and in contact with the heat conductive plate to conduct heat therefrom into the pressurized fluid. An outlet passage communicates with the assembly outlet to discharge the pressurized fluid.

20 Claims, 14 Drawing Sheets

Plate removed

(51) Int. Cl.

| | |
|---|---|
| ***F04C 2/10*** | (2006.01) |
| ***F04C 11/00*** | (2006.01) |
| *F04C 29/04* | (2006.01) |

(52) U.S. Cl.

CPC ..... *F04C 15/06* (2013.01); *F04C 29/045* (2013.01); *F04C 2240/30* (2013.01); *F04C 2240/40* (2013.01); *F04C 2240/60* (2013.01)

(56) References Cited

U.S. PATENT DOCUMENTS

| | | | | |
|---|---|---|---|---|
| 6,321,563 | B1 | 11/2001 | Ikeda et al. | |
| 2005/0196306 | A1* | 9/2005 | Del Zanno | F04D 25/06 417/423.15 |
| 2006/0057005 | A1* | 3/2006 | Williams | F04D 13/0606 417/423.14 |
| 2006/0078444 | A1* | 4/2006 | Sacher | F04B 49/065 417/423.3 |
| 2014/0017073 | A1* | 1/2014 | Muizelaar | F04D 13/0606 415/177 |
| 2014/0161630 | A1 | 6/2014 | Binder et al. | |
| 2014/0363318 | A1 | 12/2014 | Wang et al. | |
| 2016/0061221 | A1 | 3/2016 | Lee | |
| 2016/0135283 | A1* | 5/2016 | Chauvin | H05K 7/20163 361/697 |
| 2016/0138587 | A1 | 5/2016 | Huang et al. | |
| 2016/0245283 | A1 | 8/2016 | Chikaoka | |

FOREIGN PATENT DOCUMENTS

| | | | |
|---|---|---|---|
| DE | 102007036240 | A1 | 2/2009 |
| EP | 2199617 | A2 | 6/2010 |
| WO | 2012/024778 | A1 | 3/2012 |

OTHER PUBLICATIONS

Written Opinion of the International Searching Authority PCT/IB2017/054370 dated Nov. 29, 2017.

International Preliminary Report on Patentability PCT/IPB2017/054370 dated Oct. 12, 2018.

Supplementary Extended European Search Report dated Apr. 17, 2020 issued in corresponding EP Application No. 17830585.0 (8 pgs.).

* cited by examiner

Hydraulic housing removed

Pump Housing and Parts removed

PUMP ASSEMBLY HAVING INTEGRATED CONTROLLER AND MOTOR WITH INTERNAL ACTIVE COOLING

CROSS REFERENCE TO RELATED APPLICATIONS

This patent application claims priority to provisional patent applications 62/364,540 filed on Jul. 20, 2016 and 62/404,975 filed on Oct. 6, 2016, both of which are incorporated by reference herein in their entireties.

BACKGROUND

Field

The present disclosure is generally related to a pump for providing pressurized fluid to a system. More specifically, the pump is associated with an engine and has an integrated controller.

Description of Related Art

It is known, in some cases, to provide a dedicated electrical motor and a controller (with a circuit board and other electrical components) for operation of lubricant pump. The controller requires a large surface area and cooling interface to remove heat generated by efficiency losses. This results in limited space for the pump, particularly because the space to accommodate installation of the pump, motor, and controller is typically predefined and already limited. With limited space for the pump, optimization of pump performance can be an issue.

Some designs, such as shown in FIG. 1, provide the controller at a back or end of the motor, with the pump on the opposite end of the motor. Other known designs include the pump flanked at its ends by the controller and the motor. During operation of the pump and engine, the temperature rises within the housings. High temperatures may cause problems in the pump parts and controller, and may even lead to failure. In the above-mentioned types of configurations, the controller is typically cooled only by the atmospheric air flow.

In addition, conventionally, positive and negative power connectors are also overmolded into the controller cover. The positioning of the connectors on the controller cover or housing also subjects them to damage and/or failure.

Also, in traditional designs, in order to produce the desired displacement from the pump, the diameter of the pumping elements tends to be larger in diameter and length than what is optimal. This results in a need for a higher torque to drive the pump, which is undesirable.

SUMMARY

It is an aspect of this disclosure to provide a pump assembly that has an assembly inlet for inputting fluid, an assembly outlet for outputting fluid, an electric motor contained within a motor casing, a pump having a pump housing, a drive shaft connecting the electric motor to the pump, and a controller configured to drive the electric motor. The pump has an inlet for receiving input fluid from the assembly inlet and a transfer outlet for outputting pressurized fluid. The drive shaft is configured to be driven about an axis by the electric motor. The pump and the electric motor are on opposing axial sides of the controller. The pump assembly also has a heat conductive plate positioned between the pump and the controller, for conducting heat from the controller. A transfer passage is also provided in the pump assembly for receiving the pressurized fluid output from the transfer outlet of the pump and directing the pressurized fluid along and in contact with the heat conductive plate to conduct heat therefrom into the pressurized fluid. An outlet passage communicates the transfer path with the assembly outlet to discharge the pressurized fluid.

Another aspect provides a method for cooling a pump assembly. The pump assembly may be as noted above, for example. The method includes driving the electric motor using the controller; driving the drive shaft; inputting fluid through the assembly inlet of the pump assembly and into the inlet of the pump; pressurizing input fluid using the pump; outputting pressurized fluid via the transfer outlet into the transfer passage; directing the pressurized fluid along and in contact with the heat conductive plate; and discharging the pressurized fluid through the assembly outlet.

Other aspects, features, and advantages of the present disclosure will become apparent from the following detailed description, the accompanying drawings, and the appended claims.

DETAILED DESCRIPTION OF THE PREFERRED EMBODIMENT(S)

The location, direction, and use of the term "side" herein and throughout this disclosure with reference to the controller 26 and any of the components of the pump assembly 10 are not intended to be limiting, and it should be understood that such features could also be referred to as a top, bottom, upper, lower, first, second, etc. in this disclosure. The location, direction, and corresponding terms are simply for explanatory purposes with reference to the Figures of the illustrated embodiment. In addition, examples and terms described with regards to direction are for explanatory purposes only; it should be understood that, in some cases, the description of direction and/or side may be altered based on a positioning or mounting of the disclosed pump assembly within a vehicle. Accordingly, such terms should be understood to refer to the illustrated exemplary embodiments and not be construed as being intended to limit the assembly when mounted or configured for use within a vehicle or other machine.

Figure 1:
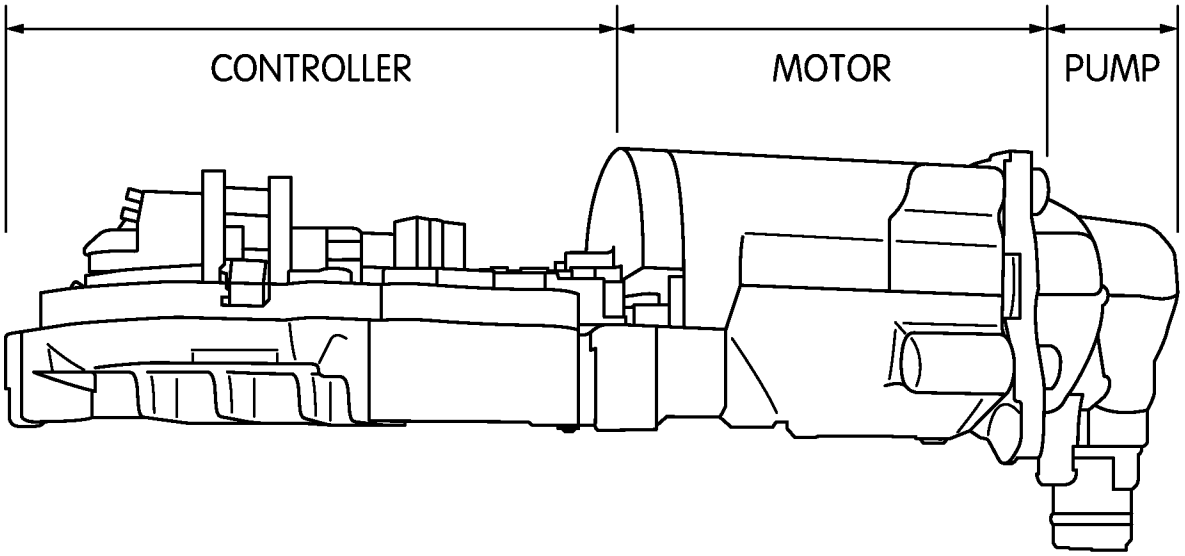
FIG. 1 PRIOR ART
FIG. 1 shows an example of a pump according to the prior art.
Figure 2:
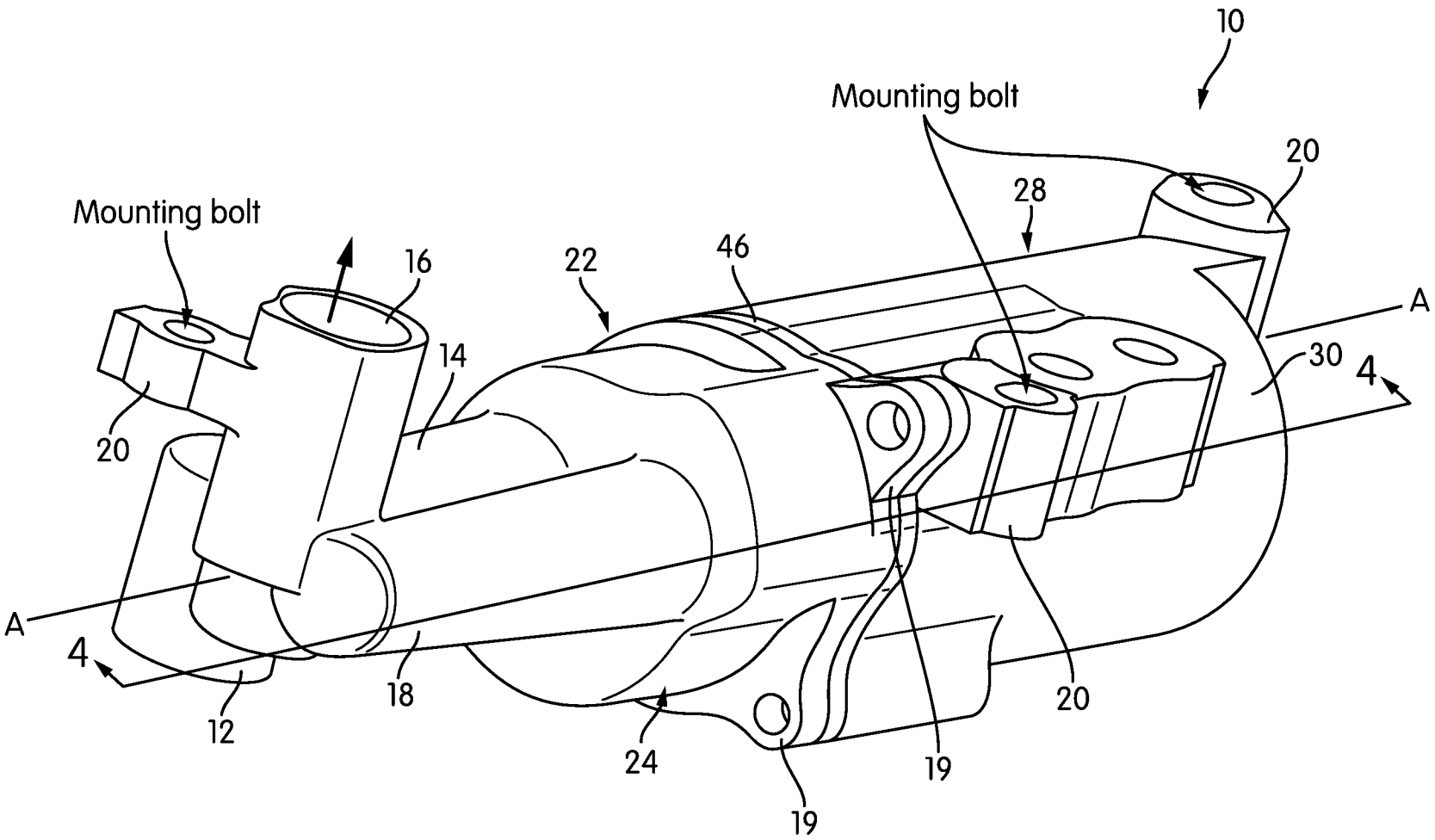
FIG. 2 is an isometric view of a pump assembly in accordance with an embodiment of this disclosure.
Figure 3:
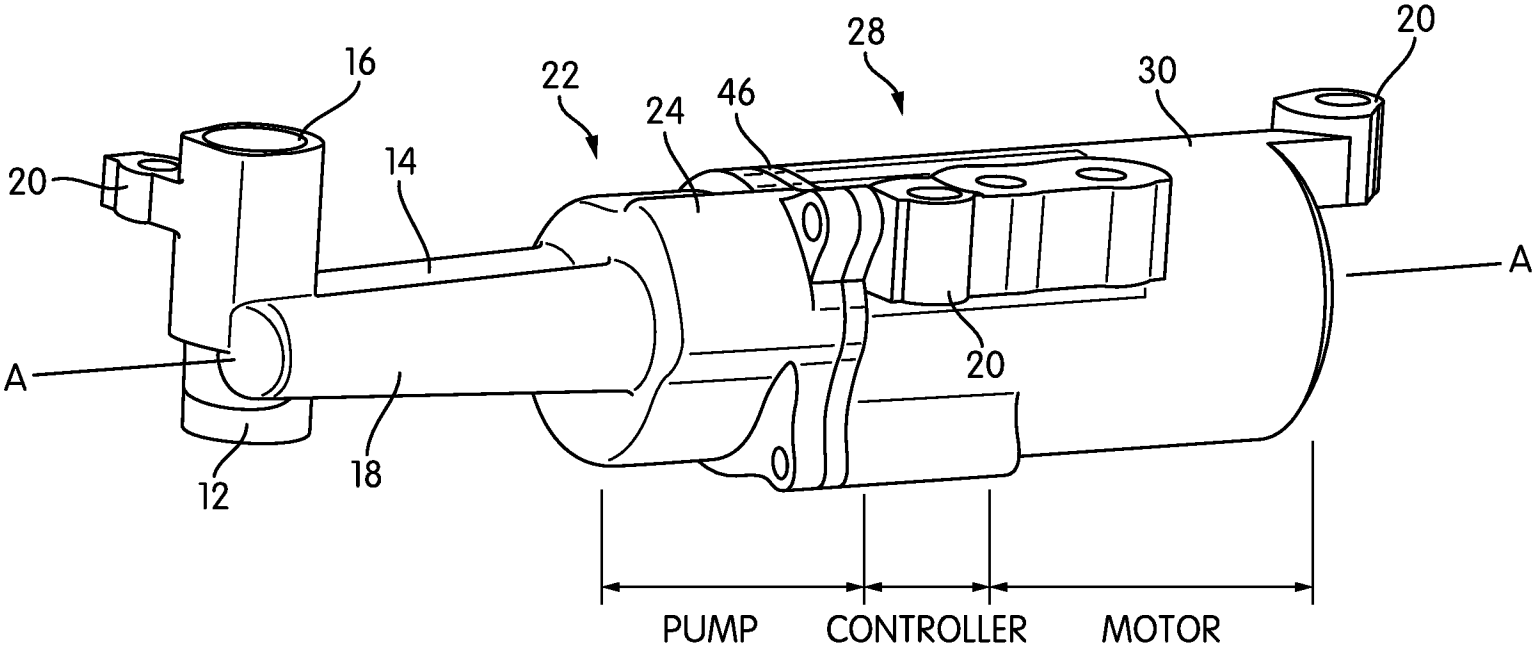
FIG. 3 is a side view of the pump assembly of FIG. 2.

FIGS. 2 and 3 illustrate a pump assembly 10, in accordance with an embodiment herein, with its housing and components positioned longitudinally along an axis A. The pump assembly 10 includes an assembly inlet 12 for inputting fluid, such as a lubricant (e.g., oil or transmission fluid), and an assembly outlet 16 for outputting fluid, i.e., fluid that is pressurized by a pump 22 contained therein. The pump assembly 10 may supply pressurized fluid to a transmission or an engine of an automotive vehicle, for example. In an embodiment, the direction of flow into the assembly inlet 12 and/or from the assembly outlet 16 may be perpendicular to an overall axial length of the pump assembly 10. In another embodiment, at least one of the inlet 12 and/or outlet 16 direct flow into the pump in a perpendicular or angled direction relative to the longitude or axial length of the pump assembly 10. In the illustrated embodiment, the fluid enters the pump assembly 10 through the assembly inlet 12 (e.g., vertically or horizontally) and is guided through an inlet passage defined by an inlet pipe 14 to the pump 22 (e.g., in a longitudinal or axial direction). The inlet pipe 14 has an axial length and is fluidly connected to the pump 22 via an inlet 25 thereof (e.g., see FIG. 5), which is further described later. Pressurized fluid from the pump 22 is output via an output passage defined by an outlet pipe 18 (e.g., in a longitudinal or axial direction) and through the assembly outlet 16 (e.g., vertically or horizontally). The outlet pipe 18 has an axial length and is parallel to the inlet pipe 14, in accordance with an embodiment. The input flow of fluid through pipe 14 and the output flow of fluid through pipe 18 may be in generally parallel but opposite directions (as compared to one another). Each of the pipes 14 and/or 18 may have generally laminar flow of fluid therethrough.

Pipes 14 and 18 may be formed from metal, plastic, or any other suitable material. The length of the inlet pipe 14 and/or outlet pipe 18 as shown in the Figures is not intended to be limiting. Pipes 14 and 18 may have a similar length, for example, or one may be shorter than the other. In an embodiment, lightweight aluminum or plastic may be used for at least part of the length of the pipe 14 and/or 18. Moreover, the length(s) of the pipe(s) 14, 18 may be adjusted to accommodate other parts associated with the pump, e.g., such as a pressure relief valve, which are not specifically illustrated here. In accordance with an embodiment, the axial length of the pipes 14, 18 is minimized such that the overall axial length of the pump assembly 10 is minimized thereby providing a more compact package for installation. This in turn allows for more options to minimize leakage at higher temperatures and to reduce the diameter of the pumping elements.

Figure 4:
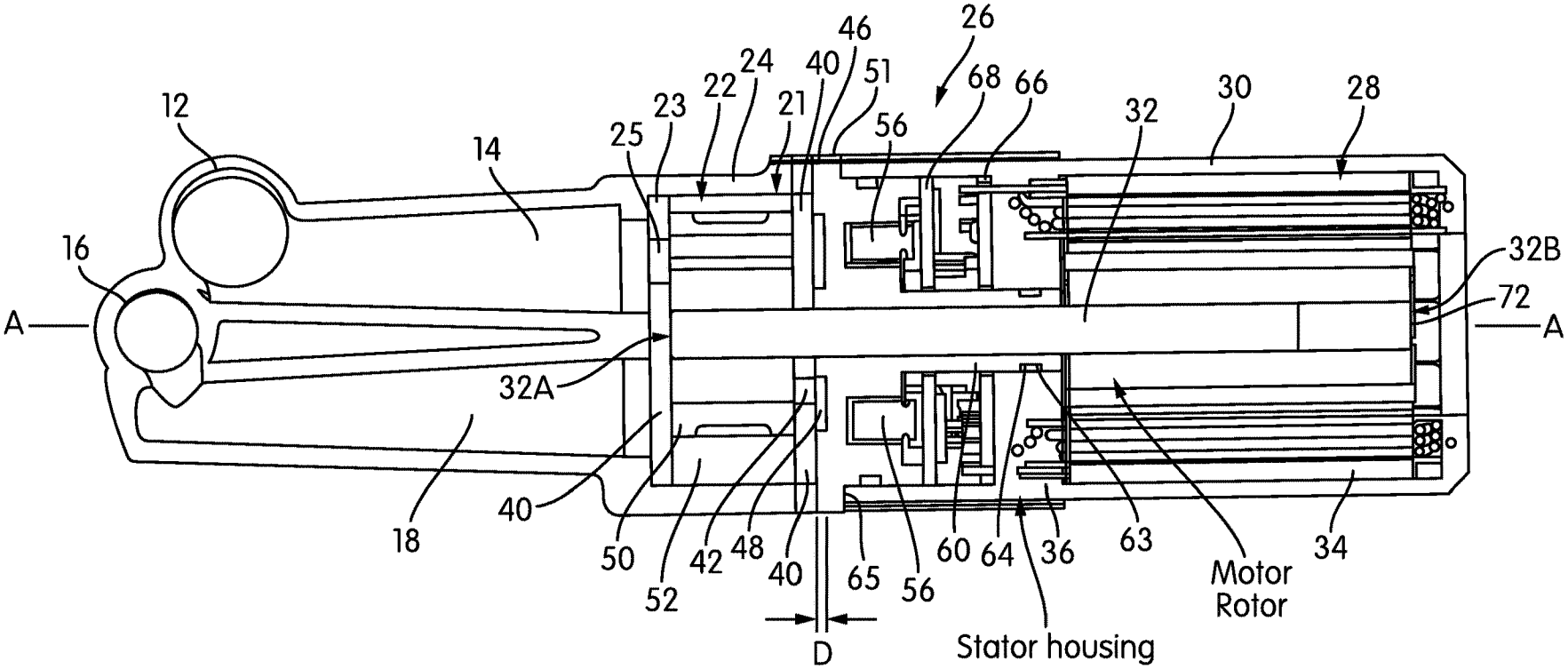
FIG. 4 is a cross-sectional view of the pump assembly as taken along line 4-4 in FIG. 2, showing components in their housings.

In the pump assembly 10, a controller 26 is housed therein and the pump 22 and an electric motor 28 are on opposing axial sides of the controller 26. That is, the controller 26 is axially flanked by the pump 22 and the motor 28. As seen in the cross-sectional view of FIG. 4, for example, the pump 22 and its housing 24 are provided on one side (a "pump side") (e.g., a left side as shown in FIG. 4) of the controller 26 and the motor 28 and its casing 30 are provided on an opposite axial side (a "motor side") (e.g., a right side as shown in FIG. 4) of the controller 26. In an embodiment, the pump housing 22 and the motor casing 30 are connected together to contain and house the controller 26 within the pump assembly 10. Inside the pump assembly 10, a drive shaft 32 connects the electric motor 28 to the pump 22. The drive shaft 32 is driven about axis A by the electric motor 28 to drive the components of the pump 22. The controller 26 controls and thus drives the electric motor 28 to drive the shaft 32.

Figure 13:
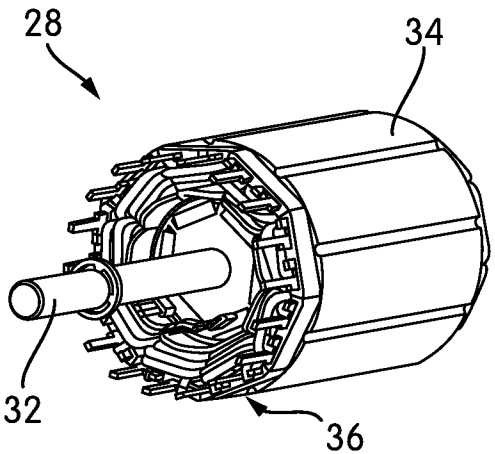
FIG. 13 is an isometric view of parts of a motor provided in a motor housing of the pump assembly of FIG. 2, in accordance with an embodiment.

The electric motor 28 includes a rotor 34 and a stator 36, which are shown in FIG. 13. The rotor 34 is connected to the shaft 32 is contained within the casing 30 along with the stator 36. The motor casing 30 is generally cylindrical and the stator 36 may be fixed thereto.

Figure 5:
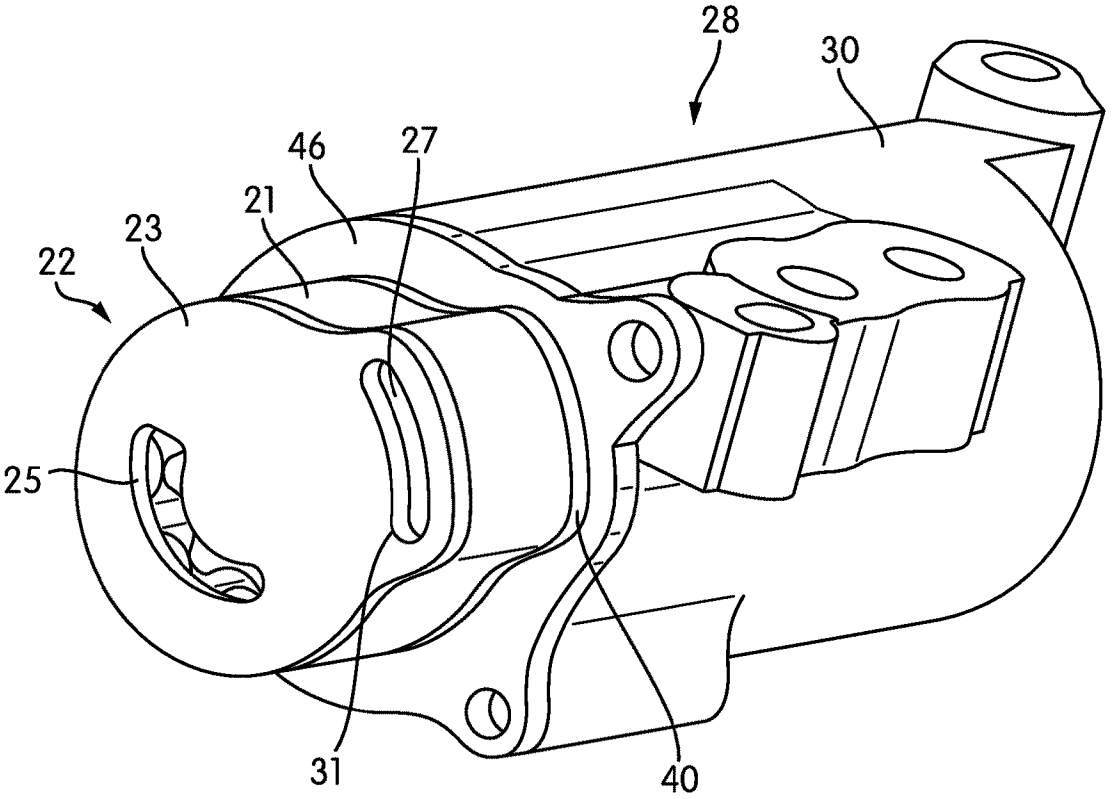
FIG. 5 is an isometric view of parts of the pump assembly of FIG. 2, with the pump hydraulic housing removed and showing parts of the pump.

Referring back to FIGS. 2 and 3, in the pump assembly 10, the inlet pipe 14 and outlet pipe 18 are fluidly connected to the pump 22. The pump 22 is encased by a pump hydraulic housing 24, also referred to herein as a pump casing 24. In accordance with an embodiment, the pump casing 24 may be integrally formed with the inlet pipe 14 and outlet pipe 18. The pump casing 24 encloses the functional pump parts therein and may be shaped to accommodate its pumping parts as well as an outlet passage 27 for directing output flow towards the outlet passage defined in the outlet pipe 18. As shown in FIG. 5, for example, the pump 22 includes pump cover plate 23, a parts housing 21 and a port plate 40. The cover plate 23 and port plate 40 are provided at opposite ends of the parts housing 21. When assembled, in accordance with one embodiment, the pump casing or pump hydraulic housing 24 surrounds the parts housing 21 to contain the pump components, as shown in FIG. 4. Alternatively, in another embodiment, the pump part may be configured for containment within the pump hydraulic housing 24 and a distinct parts housing 21 need not be provided.

Figure 6:
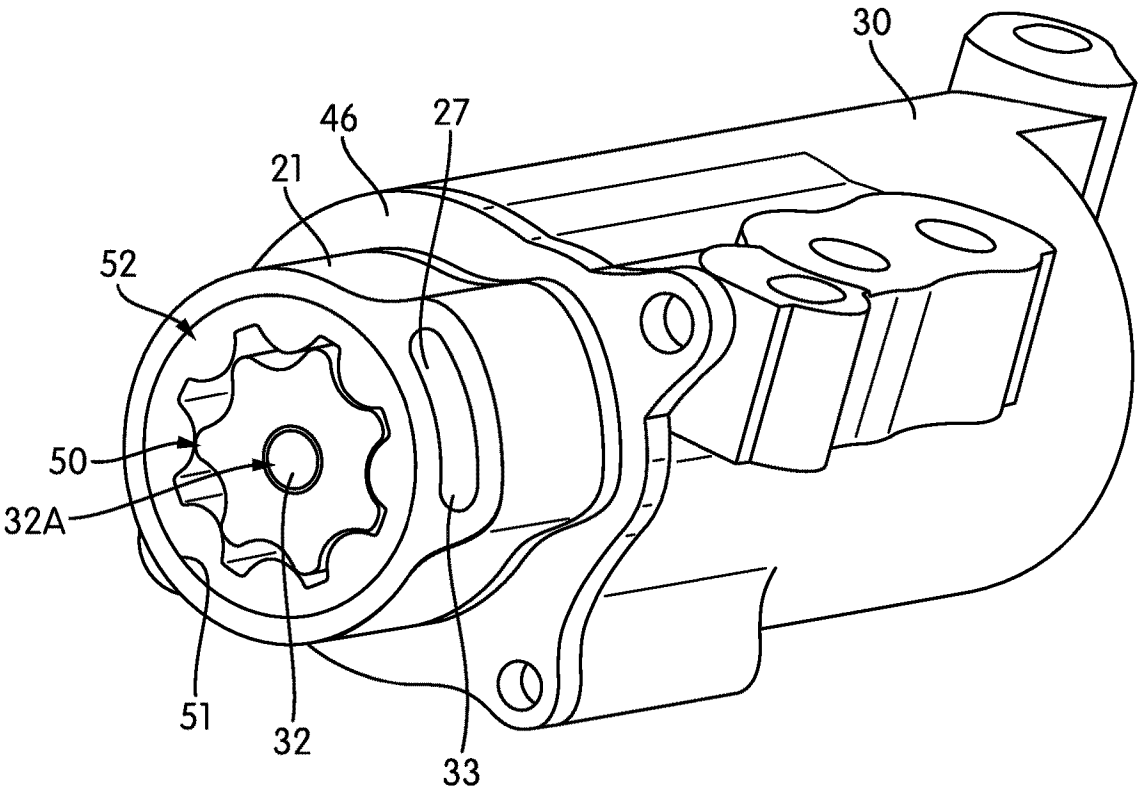
FIG. 6 is an isometric view of parts of the pump assembly of FIG. 2, with the pump cover plate removed and showing internal parts of the pump.

FIG. 5, illustrated here with the pump hydraulic housing 24 removed for illustrative and descriptive purposes, shows that the pump cover plate 23 includes the inlet port 25 or opening for receiving input fluid from the inlet pipe 14. The pump cover plate 23 also has an outlet port 31 for the pump 22 that aligns with a passageway 33 (see FIG. 6) of the parts housing 21 to form the outlet passage 27, which may be aligned with the suction side of the pump 22. The outlet passage 27 of the pump 22 directs any output pressurized fluid from the pump 22 to (and through) the outlet pipe 18. The outlet passage 27 is radially adjacent to and isolated from a pump chamber 51 (shown in FIG. 6). In the exemplary illustrated embodiment, the outlet passage 27 and port 31 are curved or crescent shaped. The inlet port 25 may also be curved or crescent shaped. The illustrated and described shape of the port 25 and/or outlet passage 27 and port 31, however, is not meant to be limiting.

As described in greater detail below, the output pressurized fluid from the pump 22 is also used for internal thermal management of the pump assembly 10. In particular, because the controller 26 is temperature sensitive, the pressurized output flow is directed such that it is circulated near the controller 26 in order to receive and remove heat radiated or conducted from electronic components of the controller 26. Accordingly, the herein disclosed design preferably maintains the temperature of the controller 26 below a predetermined temperature to avoid failure of the electronic components of the controller 26, and thus, the pump assembly 10.

The type of pump 22 and its parts provided in the pump assembly 10 is not limited. In accordance with an embodiment, the pump 22 has a gerotor drive, wherein an inner rotor 50, shown in FIG. 6 (illustrated with the pump cover plate 23 removed for illustrative and descriptive purposes), is rotatable driven by the drive shaft 32 to in turn rotatable drive an outer rotor 52. The inner rotor 50 is fixedly secured to the shaft 32 for rotation about axis A with the drive shaft 32. A pump end 32A of the shaft 32 is positioned adjacent or next to the pump cover plate 23, as shown in FIG. 4, and freely rotates. As shown in FIG. 4, a motor end 32B of the shaft is secured by an end bracket 72. Referring back to FIG. 6, the outer rotor 52 is rotatably received in the pump parts housing 21, and particularly the pump chamber 51 thereof. The pump chamber 51 and the outer surface of the outer rotor 52 are cylindrical, and the pump chamber 51 is radially isolated from the part of the housing 21 defined the passageway 33. As is understood by one of ordinary skill in the art, rotation of the inner rotor 50 also rotates the outer rotor 52 via their intermeshed teeth to pressurize the input fluid received in areas between the complimentary parts for output from the pump 22, and thus such details are not described here. Other types of pump parts for pressurizing input fluid may also be used in pump 22 in accordance with other embodiments, including gear pumps, and thus pump 22 should not be limited to gerotor-type pumps. As noted previously, the passageway 33 is and forms part of the outlet passage 27 for directing pressurized fluid from the pump 22. In accordance with an embodiment, the passageway 33 may be curved or crescent shaped. The shape of the passageway 33, however, is not meant to be limiting.

Figure 7:
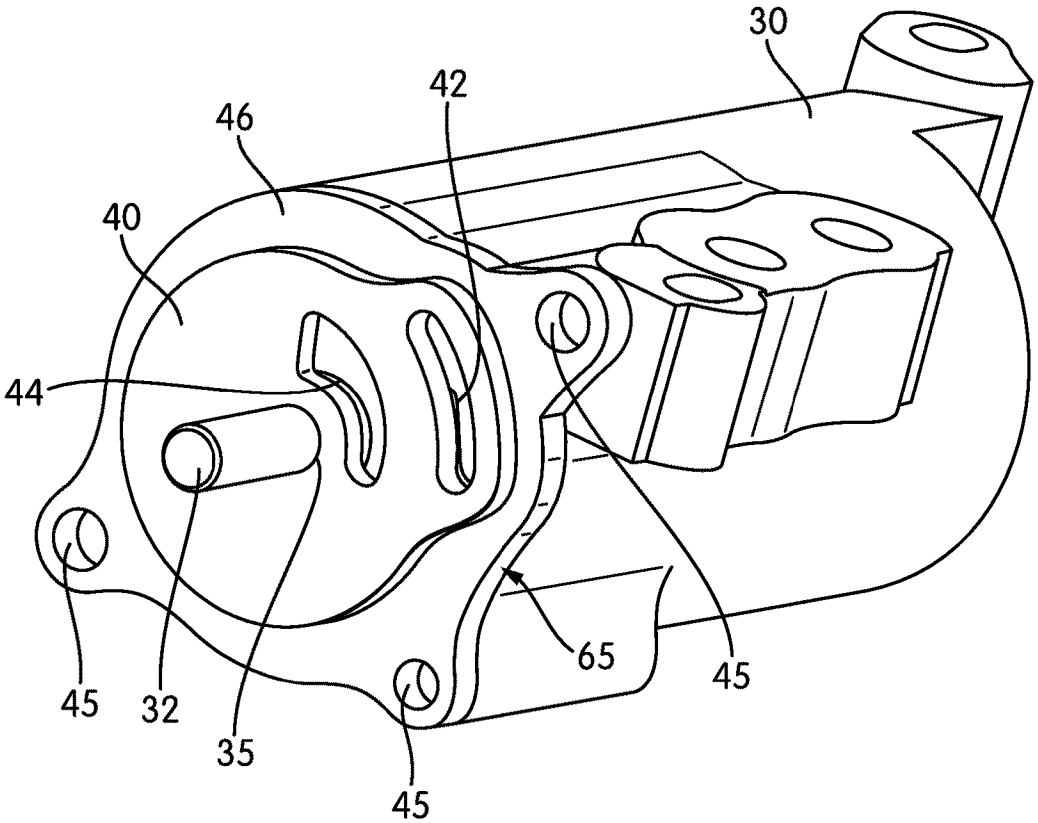
FIG. 7 is an isometric view of parts of the pump assembly of FIG. 2, with portions of the pump removed and showing a port plate of the pump.

FIG. 7 shows additional details of the port plate 40 of the pump 22, with the parts housing 21 and rotor 50, 52 of the pump 22 removed therefrom for illustrative and descriptive purposes. The port plate 40 has an opening 35 for receipt of the drive shaft 32 therethrough. Transfer outlet opening 42 aligns with the passageway 33 of the parts housing 21. In an embodiment, the transfer outlet opening 42 may be curved or crescent shaped; however, such a shape is not intended to be limiting. In one embodiment, the shape of the port 31, passageway 33, and transfer outlet opening 42 substantially corresponds or are substantially similar; in another embodiment, the port and passages are shaped or formed such that at least a portion of each is aligned with adjacent part(s) so as to form the outlet passage 27 therethrough. Also provided in the port plate 40 and illustrated in FIG. 4 is a controller-side or transfer outlet port 44 or opening for directing pressurized output fluid from the pump 22. This port 44 may also be curved or crescent shaped, in accordance with an embodiment, but again is not limited in its shape. The controller-side outlet port 44 may be positioned radially inward relative to the transfer outlet opening 42, e.g., closer to the opening 35 for the drive shaft 32.

The port plate 40 of the pump 22 is provided adjacent to and against a cover plate 46 which is connected to the motor casing 30, either as a separate part or formed integrally therewith. To secure the pump 22 in the pump assembly 10, the pump housing 24 has connectors 19 (see FIG. 2) whose openings are aligned with openings of connectors 45 (e.g., see FIGS. 7 and 8) on the cover plate 46. Fasteners and/or bolts (not shown) may be inserted through the aligned openings to connect and secure the pump housing 24 and connected pipes 14, 18 to the cover plate 46, and thus to the motor casing 30. Once assembled, as shown in FIG. 2, for example, the pump assembly 10 can be mounted within a vehicle by inserting fasteners and/or mounting bolts through holes in mounting portions 20 provided on the pump housing 24 (e.g., near assembly outlet 16) and motor casing 30, and securing the fasteners/bolts to the vehicle.

The cover plate 46 may be formed from any number of heat conductive materials, such as aluminum or other metals.

Figure 8:
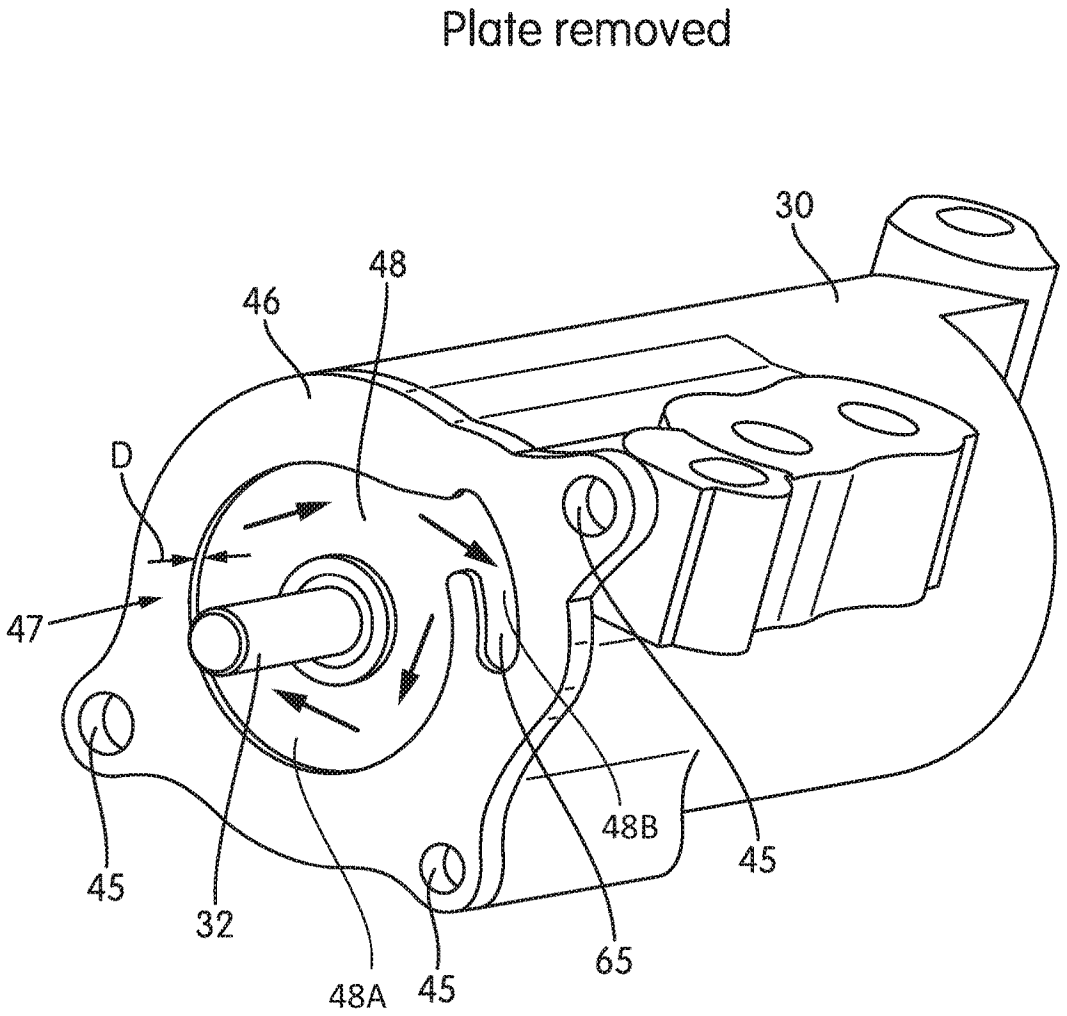
FIG. 8 is an isometric view of parts of the pump assembly of FIG. 2, with the pump and port plate removed, showing a first axial side of a cover plate.
Figure 12:
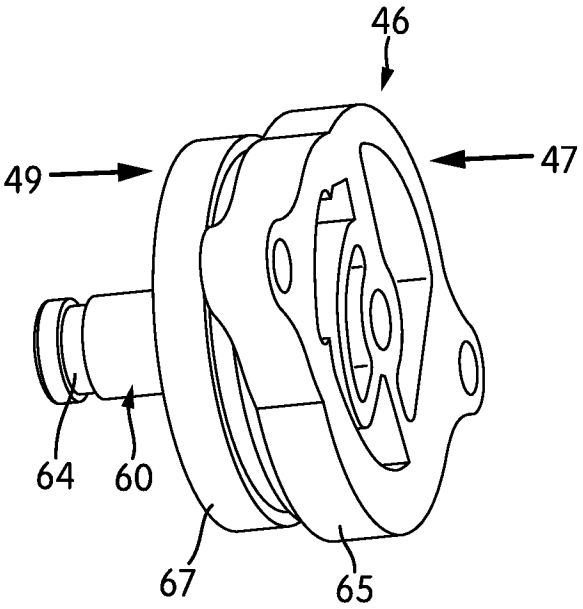
FIG. 12 is an alternate view of the cover plate of FIG. 11.
Figure 11:
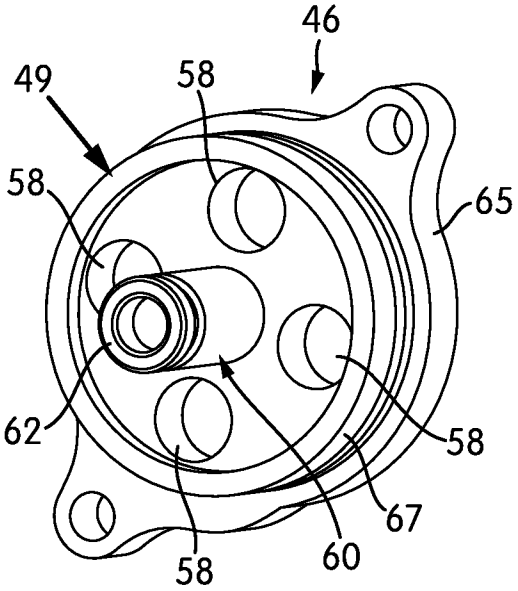
FIG. 11 illustrates a second axial side of the cover plate shown in FIG. 8.
Figure 17:
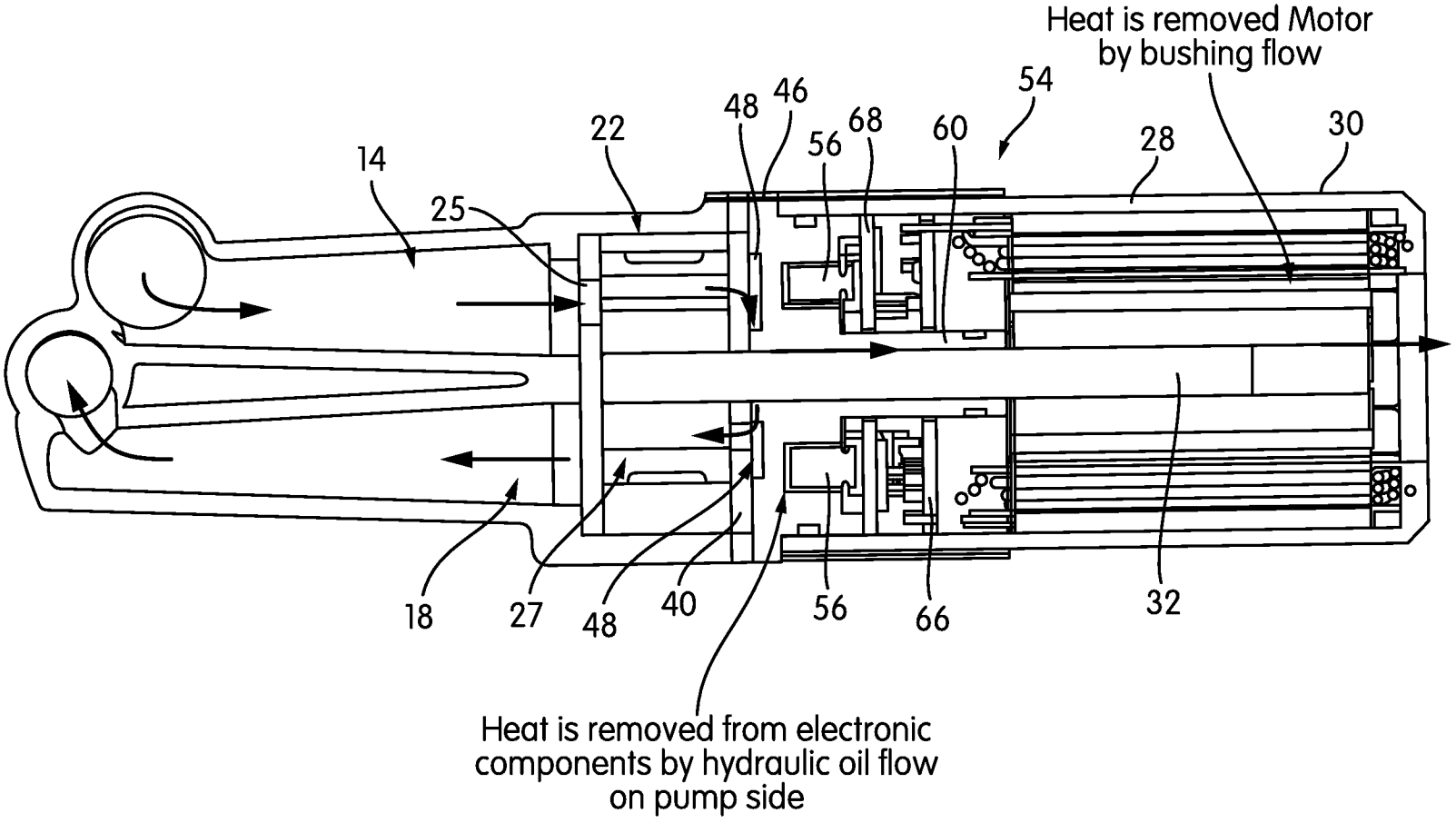
FIG. 17 is a graphical representation of the fluid flow within the pump assembly of FIG. 2.
Figure 18:
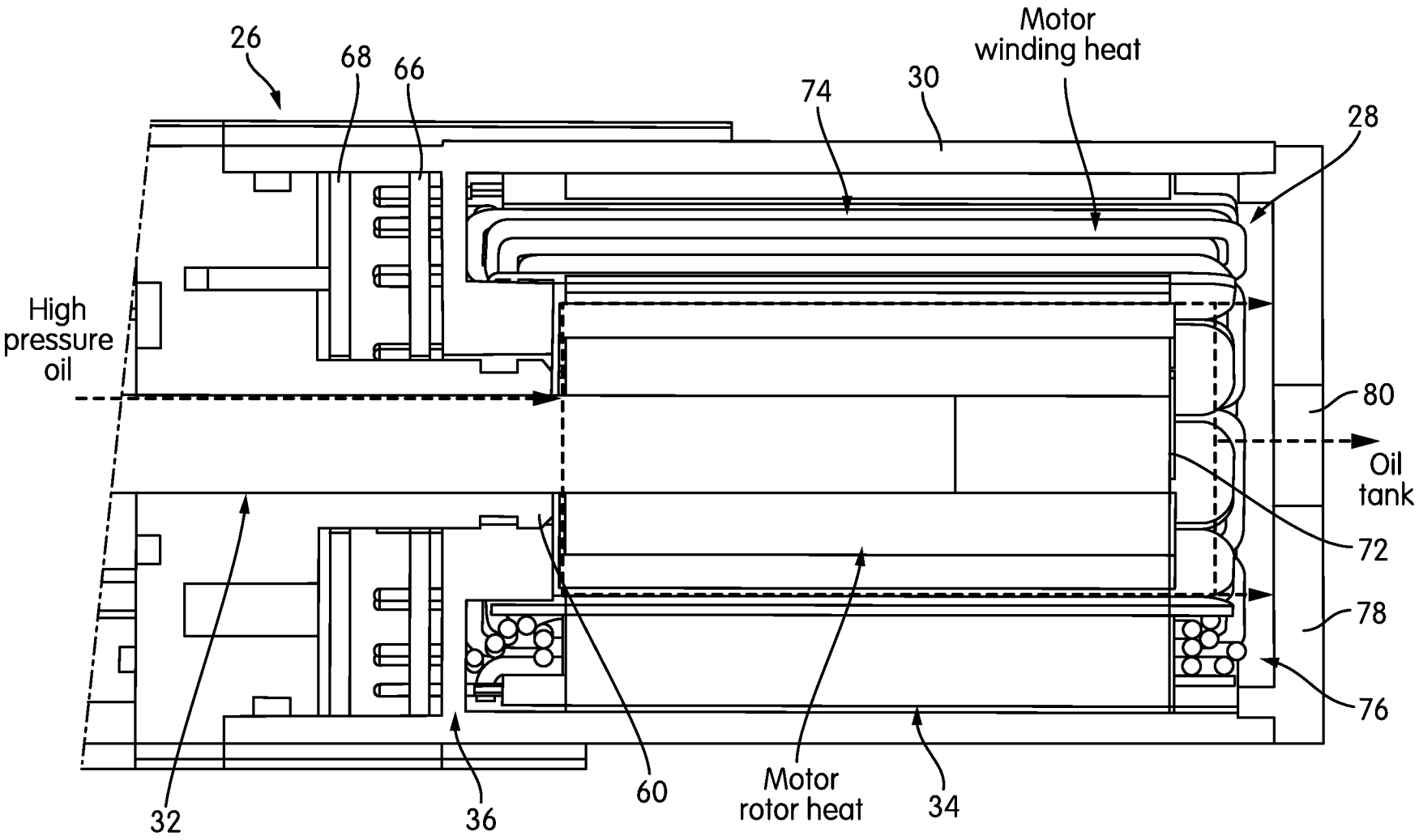
FIG. 18 illustrates part of the cross section of the pump assembly including a path for a flow of fluid for cooling parts of the motor.

The cover plate 46 has a first axial side 47 and a second axial side 49 (see also, e.g., FIGS. 11 and 12). The first axial side 47 of the cover plate 46 is shown in FIG. 8 (wherein the pump 22 and port plate 40 are removed for illustrative and descriptive purposes). The first axial side 47 (also referred to as the pump-facing side) of the cover plate 46 faces the pump 22 and is in contact with a bottom or back axial side of the port plate 40. The second axial side 49 (also referred to as the controller-facing side) of the cover plate 46, shown in FIG. 11, for example, faces the controller 56 and its associated parts. The second axial side 49 includes a bushing 60, that extends from its motor-facing surface, for receiving the drive shaft 32. The bushing 60 receives the drive shaft 32 through its longitudinal opening (see FIG. 4), for example. The drive shaft 32 rotates about axis A relative to the bushing 60. The bushing 60 may include an indentation 64 (see FIG. 12) in its outer surface for receipt of an O-ring 63 (see FIG. 9) therein, for example. In operation, a small flow portion of pressurized fluid may be directed from the pump 22 between an inner surface of the bushing 60 and an outer surface of the drive shaft 32 and towards the motor 28 (see arrows in FIG. 17 and FIG. 18). This fluid flow may assist in removing heat from the motor 28. The fluid may be directed through the bushing(s) of the motor 28 and between the rotor 34 and stator 36 to lubricate and cool the magnets and windings 74, as shown in FIG. 18. The fluid can be output or exhausted from the motor casing 30 at its end near the end bracket 72, for example. In an embodiment, the motor casing 30 includes a compartment 76 (see FIG. 18) formed between an end of the motor 28 and an end bracket 78 of the motor casing 30 for containing fluid therein before it is exhausted or expelled from the motor casing 30. The pump assembly 10 may include a port or outlet 80 for outputting the small flow portion at the motor side, such as back to a lubricant source/sump or tank, such that it may be further cooled (e.g., cooled from approximately 170 degrees Centigrade (as a result of convection from the motor to the fluid), to approximately 125-130 degrees Centigrade within the sump or tank).

Referring back to FIG. 8, the first axial side 47 of the cover plate 46 has a transfer recess 48 formed therein for directing output fluid from the pump (i.e., from the controller-side or transfer outlet port 44) in a radial direction across a surface on the first axial side 47 of the cover plate 46 and circumferentially around the drive shaft 32. Along with other parts (e.g., opening 42, passageway 33, etc.) previously described, the transfer recess 48 directs pressurized fluid towards the outlet passage 27 of the pump 22. The transfer recess 48 comprises an indentation that extends an axial depth D from the surface and into the first axial side 47 of the plate 46 (see also FIG. 4). When the port plate 40 is secured against the cover plate 46, a channel is formed in-between the back side of the port plate 40 and the recess 48 (i.e., due to the depth D of the recess extending into the cover plate 46 (that is, in towards the motor side). As described later, when output fluid flows through this formed channel and into recess 48 (also referred to as a transfer passage), heat is conducted from the cover plate 46 into the fluid or lubricant, which is continuously being removed as output or discharge flow. Accordingly, cover plate 46 acts as a heat conductive plate between the pump and the controller to conduct heat from the controller of the pump assembly 10.

A radial width (i.e., a distance from a point near the driving shaft 32 to a point (edge of the recess 48) that is positioned radially outward towards an outer edge of the cover plate 46) of the transfer recess 48 around or relative to the drive shaft 32 can vary in dimension and shape. In one embodiment, the recess 48 has a generally circular shape 48A as well as a peninsula-shaped portion 48B connected to the circular shape, as illustrated in FIG. 8, for example. The generally circular shape 48A may correspond to an internal receiving space of the pump parts housing 21 that contains the rotors 50, 52 therein, and the peninsula-shaped portion 48B may correspond to the shape to the outlet passage 27, including passageway 33, and transfer outlet opening 42. The shape of the transfer recess 48 in the cover plate 46, however, is not intended to be limiting. In an embodiment, the indentation or depth D of the transfer recess 48 covers at least 50% of the surface area of the cover plate 46 to increase the amount of heat transfer to the fluid/lubricant and overall heat removed as the fluid flows therefrom.

The illustrated embodiment of the transfer recess 48 being provided within the pump-facing side of the cover plate 46 is exemplary only and not intended to be limiting. In another embodiment, the transfer recess 48 may be provided on an underside (controller-facing side) of the port plate 40, e.g., an indentation is provided that extends an axial depth from a surface of and into the port plate 40 (in towards the pump side). In one embodiment, the pump-facing or first axial side 47 of the cover plate 46 is a flat surface. When the port plate 40 is secured against the cover plate 46, the channel or transfer recess formed therebetween. Heat is conducted from the cover plate 46 into the fluid or lubricant as the fluid flow is directed along and in contact with the cover plate 46. Accordingly, port plate 40 may act as a heat conductive plate between the pump and the controller to conduct heat from the controller.

In another embodiment, both of the port plate 40 and cover plate 46 may include a recess or indentation therein, each recess or indentation having an axial depth, that, when the plates 40, 46 are positioned against each other and assembled, their respective recesses/indentations are aligned to form the channel or a slot, i.e., a transfer recess 48, therebetween. The depth of the recesses in both of the plates 40, 46 may be different or substantially equal.

The controller 26 is configured to operate or drive the electric motor 28 (e.g., control a magnetic field of the stator 36 of the motor 28), to thus control the pump 22. The controller 26 and its components may be contained within the motor casing 30 by securing the cover plate 46 thereto. For example, as seen in FIG. 4, the cover plate 46 may include a flange portion 65 (see also FIGS. 11 and 12) that is aligned against an edge 57 of the motor casing 30. A neck portion 67 extends from the second axial side 49 of the cover plate 46 and is press-fit into the motor casing 30 to sealingly secure and contain components of the controller 26 from the fluid of the pump 22. One or more O-rings or seals may also be used. Other methods or devices for securing the cover plate 46 to the motor casing 30, however, may also be used.

Figure 9:
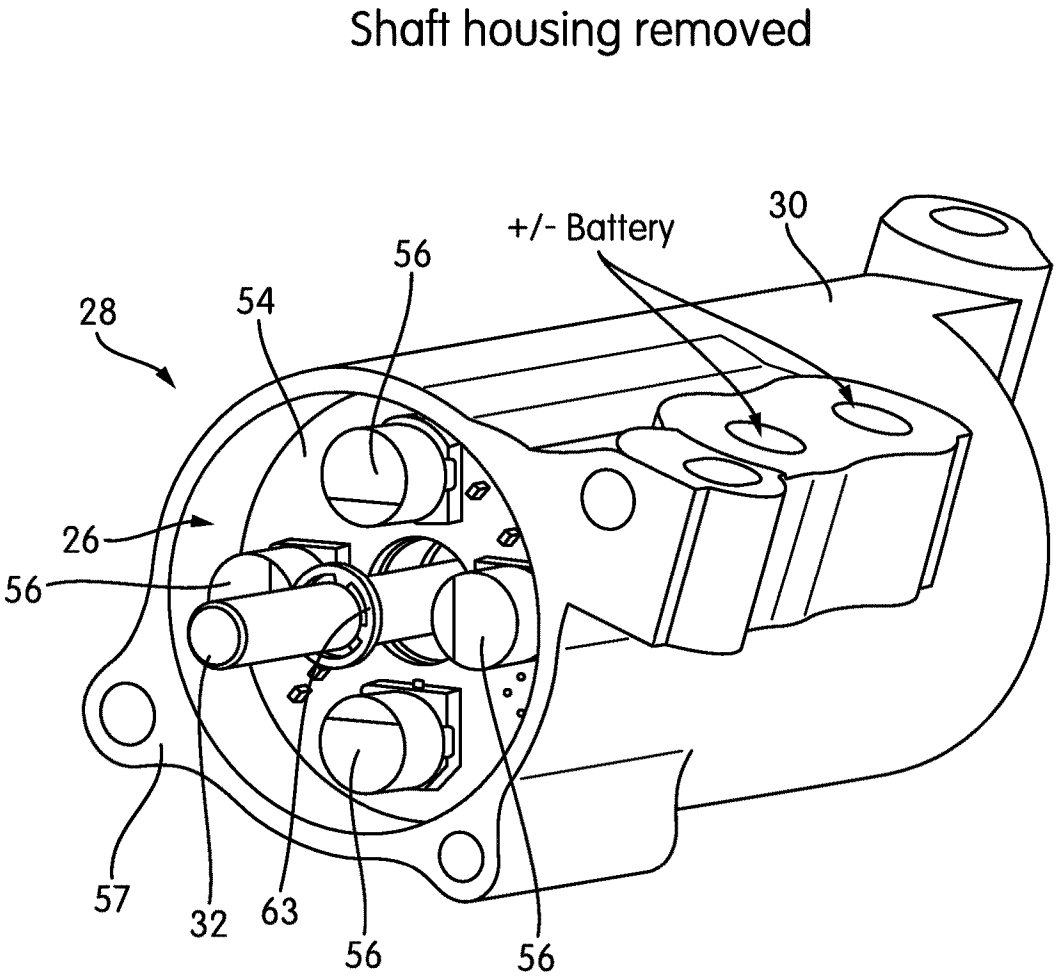
FIG. 9 is an isometric view of parts of the pump assembly of FIG. 2, with the cover plate removed and showing parts of the controller within the pump assembly and a shaft, in accordance with an embodiment.
Figure 10:
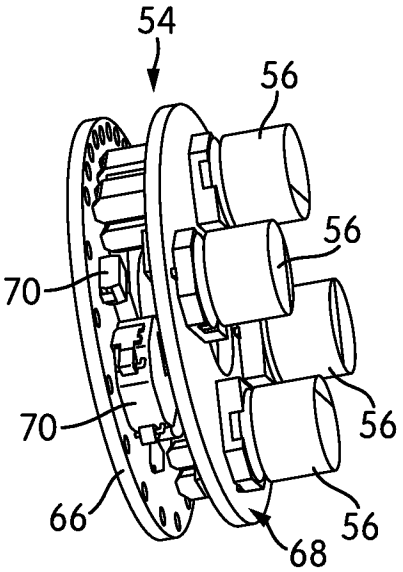
FIG. 10 illustrates parts of the controller provided within the pump assembly, in accordance with an embodiment.

As shown in FIGS. 9 and 10, the controller 26 includes an electronic control unit, or ECU, 54 that has multiple capacitors 56 associated therewith (FIG. 9 is illustrated with the cover plate 46 removed for illustrative and descriptive purposes). In an embodiment, for example, the capacitors 56 are arranged in a spaced configuration on an upper side or pump-facing side 68 of the ECU 54 such that they are positioned around the drive shaft 32 in a circumferentially spaced relationship. FIG. 11 shows the second (i.e., controller-facing) axial side 49 of the cover plate 46 wherein the neck portion 67 includes circumferentially spaced indentations 58 to accommodate and receive each of the capacitors 56. In an embodiment, thermal paste is provided between ECU 54 and the cover plate 49 to increase conduction. For example, thermal paste may be provided within each of the indentations 58 between the capacitors 56 and an inside thereof. The ECU 54 includes a central hole therein (see FIGS. 9 and 15) to allow the drive shaft 32 to extend through.

Although four capacitors 56 are illustrated in FIG. 9 and FIG. 10, for example, the number of capacitors is not intended to be limited. Any number of capacitors 56 may be associated with the controller or its circuit board(s). In addition, although not discussed in detail herein, it should be understood that any number of other electrical and electronic parts, sensors, chips, etc. may be used and/or provided as part of the ECU 54 and/or mounted on the board.

Figure 14:
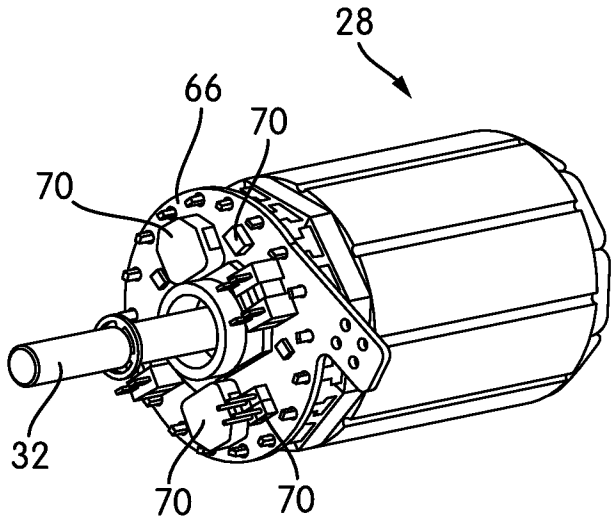
FIGS. 14 and 15 are isometric views of a circuit board and capacitors of the controller connected to the shaft and the motor of FIG. 13, in accordance with an embodiment.
Figure 15:
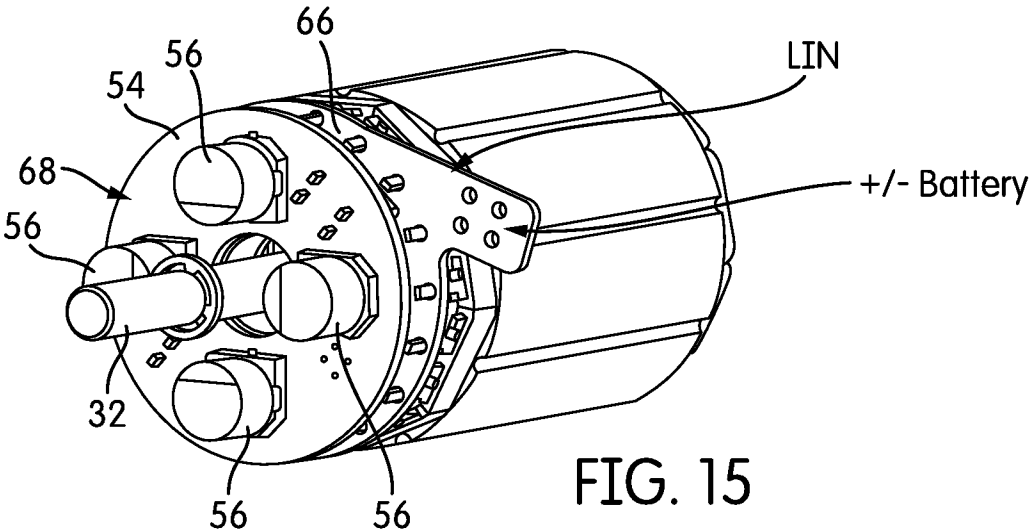

FIG. 10 and FIGS. 14-15 show additional parts of the controller 26 that include a BUS board 66 (MOSFET/printed circuit board (PCB) with integrated LIN inductors and position sensors (generally represented as components, labeled 70) mounted thereon. The BUS board 66 is positioned adjacent to the motor 28 and is used to connecting stator windings of the stator 36 together. The BUS board 66 also includes a central hole to allow the drive shaft 32 to extend through, as shown in FIG. 14. The BUS board 66 and ECU 54 are stacked around the drive shaft 32 and electrically connected together, as shown in FIG. 15.

Figure 16:
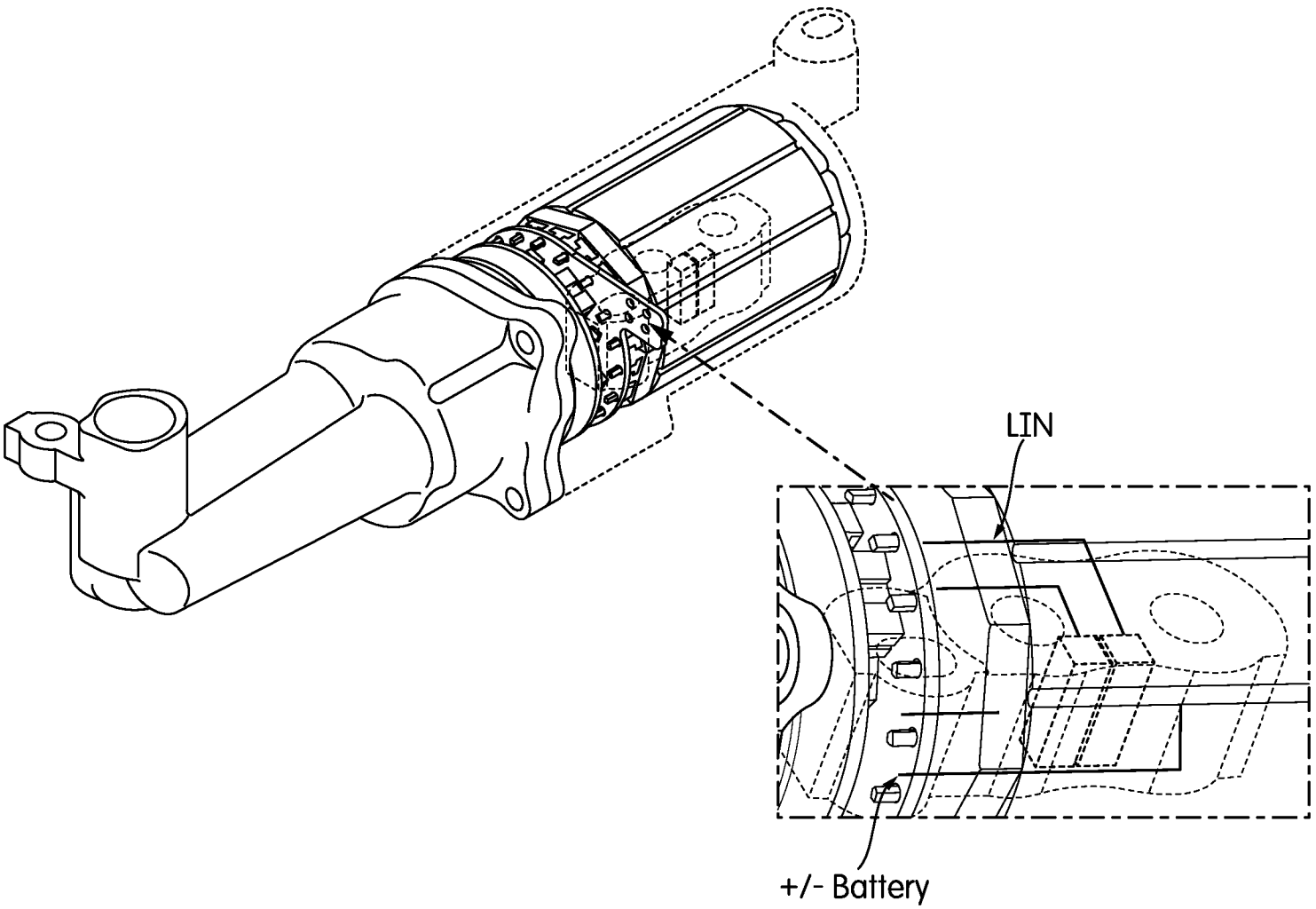
FIG. 16 is a graphical representation of electrical connections and interface of the pump assembly, in accordance with an embodiment.

The controller 26 may be electrically coupled to a power source (e.g., battery) via a local interconnect network (LIN) bus interface, as graphically represented in FIG. 16. For example, positive and negative connectors of the LIN interface may be overmolded onto an inner surface of the motor casing 30 that is positioned adjacent to the controller 26. The positioning of the connectors on the motor casing 30 reduces damage and/or failure. In addition, conventionally, positive and negative power connectors are also overmolded into the controller cover. The LIN interface and battery may be electrically connected to the BUS board 66 at points shown in FIG. 15, for example. The connections may be provided on a flange portion of the BUS board 66 that extends radially outward from the board and/or ECU 54, so that they extend towards the overmolded interface and parts within the motor casing 30.

As previously mentioned, flowing the output fluid along the cover plate 46 maintains the temperature of the controller 26 below a predetermined temperature to thus avoid failure of the electronic components of the controller 26. The controller components radiate and/or conduct heat towards the surrounding housing parts. The assembly of the capacitors 56 within the indentations 58 of the cover plate 46 may aid in maximizing heat transfer from the capacitors 56 to the cover plate 46. The flowing output fluid conductively absorbs any heat from the cover plate 46.

In the illustrated embodiment, during operation of the pump, fluid is input via inlet pipe 14 to the pump parts and pressurized using the rotor(s). Pressurized fluid is directed from the transfer outlet port 44 and in the transfer recess 48 of the cover plate 46. It is then directed through and around the formed channel/transfer passage and against the surface of the cover plate 46 (e.g., around the generally circular shape of the recess 48 which extends in a radial direction) and/or port plate 40, as represented by the arrows in FIG. 8 (see also FIG. 17). The formed channel of the transfer recess 48 is further in fluid communication with the outlet passage 27 of the pump 22 (e.g., via the peninsula-shaped portion). The recess 48 further directs the pressurized fluid from the formed channel/transfer passage towards the transfer outlet opening 42 of the port plate 40 for output through the outlet passage 27 and pump outlet port 31. The outlet passage thus fluidly communicates the transfer path formed between the pump 22 and cover plate 46 with the assembly outlet 16 to discharge the pressurized fluid. Additionally, a portion of pressurized fluid may be directed through and beyond the bushing 60 and towards the motor 28 to lubricate and cool the magnets and windings 74, as shown in FIG. 18. The fluid can be output or exhausted from the motor casing 30 via the port or outlet 80 to a lubricant source/sump or tank.

The sandwiching of the components of the controller 26 between the pump 22 and the motor 28 as described herein produces a design layout with greater performance and integration of the controller and motor within a sealed and integrated assembly. Further, the disclosed design includes active, internal cooling of both the controller and the motor/bushing—both on the pump side (via heat transfer from the MOSFET/PCB/BUS board 66 and ECU 54 of the controller 56 to the fluid) and on the motor side (by pushing pressurized fluid through the bushing 60 for heat transfer from parts of the motor 28)—while still providing a substantially full output flow of the pump.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A pump assembly comprising:

an assembly inlet for inputting fluid;

an inlet passage communicating the input fluid from the assembly inlet in an axial direction to a pump;

an assembly outlet for outputting fluid;

an electric motor contained within a motor casing;

the pump having a pump housing, the pump having an inlet for receiving input fluid from the inlet passage, at least one rotor for pressurizing the received input fluid, and an outlet for outputting pressurized fluid;

a drive shaft connecting the electric motor to the pump, the drive shaft being configured to be driven about an axis along the axial direction by the electric motor;

a controller provided within the motor casing and configured to drive the electric motor, wherein the pump and the electric motor are on opposing axial sides of the controller;

a heat conductive cover plate positioned between the pump and the controller, the heat conductive cover plate conducting heat from the controller and connected to the motor casing for containing the controller therein, the heat conductive cover plate comprising a first axial side and a second axial side, the first axial side of the heat conductive cover plate facing the pump housing and the second axial side of the heat conductive cover plate facing the motor casing, wherein the controller is contained by the second axial side of the heat conductive cover plate;

a transfer passage provided in the first axial side of the heat conductive cover plate, the transfer passage being provided in the form of a recess within the heat conductive cover plate that forms a channel for receiving the pressurized fluid pressurized by at least one rotor and directing the pressurized fluid in at least a radial direction along and across a surface of the heat conductive cover plate and around the drive shaft, to conduct heat therefrom into the pressurized fluid; and an outlet passage communicating the outlet of the pump with the assembly outlet to discharge the pressurized fluid from the pump assembly, the outlet of the pump being configured to receive the pressurized fluid from the transfer passage and direct said pressurized fluid out of the pump and towards the outlet passage, and the outlet passage being configured to further direct the pressurized fluid in the axial direction to the assembly outlet.

2. The pump assembly according to claim 1, wherein the pump housing and the motor casing are connected to contain and house the controller.

3. The pump assembly according to claim 1, wherein thermal paste is provided between the controller and the heat conductive cover plate.

4. The pump assembly according to claim 1, wherein the pump housing is connected to the heat conductive cover plate.

5. The pump assembly according to claim 4, wherein pump housing includes a port plate that is positioned against the heat conductive cover plate on the first axial side thereof such that the transfer passage is formed therebetween and the pump housing comprises the outlet passage radially adjacent and isolated from a pump chamber.

6. The pump assembly according to claim 1, wherein the pump housing includes a port plate that is positioned against the heat conductive cover plate on the first axial side thereof such that the transfer passage is formed therebetween and the pump housing comprises the outlet passage radially adjacent and isolated from the pump chamber.

7. The pump assembly according to claim 1, wherein the controller comprises a circuit board including a plurality of capacitors, and wherein the second axial side of the heat conductive cover plate comprises indentations therein to accommodate the plurality of capacitors therein.

8. The pump assembly according to claim 7, wherein the plurality of capacitors are arranged in a spaced configuration on a pump-facing side of the circuit board.

9. The pump assembly according to claim 8, wherein thermal paste is provided within each of the indentations between the capacitors and an inside thereof.

10. The pump assembly according to claim 7, wherein thermal paste is provided within each of the indentations between the capacitors and an inside thereof.

11. The pump assembly according to claim 7, wherein the drive shaft extends through the circuit board, and wherein the plurality of capacitors are arranged in a spaced configuration around the drive shaft.

12. The pump assembly according to claim 10, wherein the drive shaft extends through the circuit board, and wherein the plurality of capacitors are arranged in a spaced configuration around the drive shaft.

13. The pump assembly according to claim 1, wherein the outlet of the pump is configured to receive the pressurized fluid moving in the at least radial direction and direct the pressurized fluid in the axial direction out of the pump and towards the outlet passage.

14. The pump assembly according to claim 1, wherein the inlet passage and the outlet passage are parallel to another, such that flow of the input fluid through inlet passage and output flow of the pressurize fluid through outlet passage are generally parallel and in opposite directions.

15. The pump assembly according to claim 6, wherein the port plate has an opening for receipt of the drive shaft therethrough such that the pump is positioned in the pump assembly on a front axial side of the port plate and on the first axial side of the heat conductive cover plate.

16. The pump assembly according to claim 1, wherein the recess of the transfer passage is fully formed within said heat conductive plate.

17. The pump assembly according to claim 1, wherein the recess of the transfer passage has a generally circular shape as well as a portion extending radially outwardly from the generally circular shape that directs the pressurized fluid to the outlet, and wherein the portion aligns with and has a shape that corresponds to a shape of the outlet.

18. The pump assembly according to claim 1, wherein the recess of the transfer passage has a depth that covers at least 50% of a surface area of the heat conductive cover plate.

19. A method for cooling the pump assembly according to claim 1, the method comprising:

driving the electric motor using the controller;

driving the drive shaft;

inputting fluid through the assembly inlet of the pump assembly, through the inlet passage in the axial direction, and into the inlet of the pump;

pressurizing the input fluid using the at least one rotor of the pump;

outputting pressurized fluid into the transfer passage;

directing the pressurized fluid radially along the transfer passage and in contact with the heat conductive cover plate; and discharging the pressurized fluid from the transfer passage, through the outlet of the pump, into the outlet passage in the axial direction and through the assembly outlet.

20. The method according to claim 19, wherein the controller comprises a circuit board including a plurality of capacitors, wherein the drive shaft extends through the circuit board, wherein the plurality of capacitors are arranged in a spaced configuration on a pump-facing side of the circuit board, and wherein the method further comprises transferring heat from the plurality of capacitors to the heat conductive cover plate.

* * * * *